US005461808A

United States Patent [19]

Fritts

[11] Patent Number: 5,461,808

[45] Date of Patent: Oct. 31, 1995

[54] TABLE TOP BACKLIT DISPLAY

[76] Inventor: Robert W. Fritts, 1575 N. Second St., Stillwater, Minn. 55082

[21] Appl. No.: 14,809

[22] Filed: Feb. 8, 1993

[51] Int. Cl.[6] ..... G09F 13/04

[52] U.S. Cl. ..... 40/571; 362/278

[58] Field of Search ..... 40/541, 571, 564, 40/575, 610; 362/11, 278

[56] References Cited

U.S. PATENT DOCUMENTS

| | | | |
|---|---|---|---|
| 1,059,371 | 4/1913 | Kelley | 40/571 |
| 2,858,629 | 11/1958 | Carter | 40/571 X |
| 4,070,779 | 1/1978 | Gilmour | 40/575 |
| 4,074,452 | 2/1978 | Bellinder | 40/571 |
| 4,428,030 | 1/1984 | Baliozian | 362/18 |
| 4,512,098 | 4/1985 | Ready et al. | 40/564 X |
| 5,046,273 | 9/1991 | Virvo | 40/571 |

*Primary Examiner*—Brian K. Green
*Attorney, Agent, or Firm*—Joseph C. Schwalbach

[57] ABSTRACT

A tabletop backlit display for use in tradeshows which can be readily assembled and disassembled on site, and when disassembled, can be accomodated in a single shipping carton of a size acceptable at normal rates by package delivery services. A major feature is an articulated lighting unit assembly which includes a pair of lighting units each carrying three equally spaced parallel fluorescent lamps, an intermediate reflector panel and a pair of auxiliary side reflector panels, the lighting assembly being foldable, without removing the lamps therefrom, from an in line operative configuration in which all of the fluorescent lamps are equally spaced, to a compact generally U-shaped alternative or shipping configuration. The assembly is removably mounted on a frame with supporting members, and a flexible, rollable light transmissive display panel is removably mounted on the front face of the frame.

27 Claims, 6 Drawing Sheets

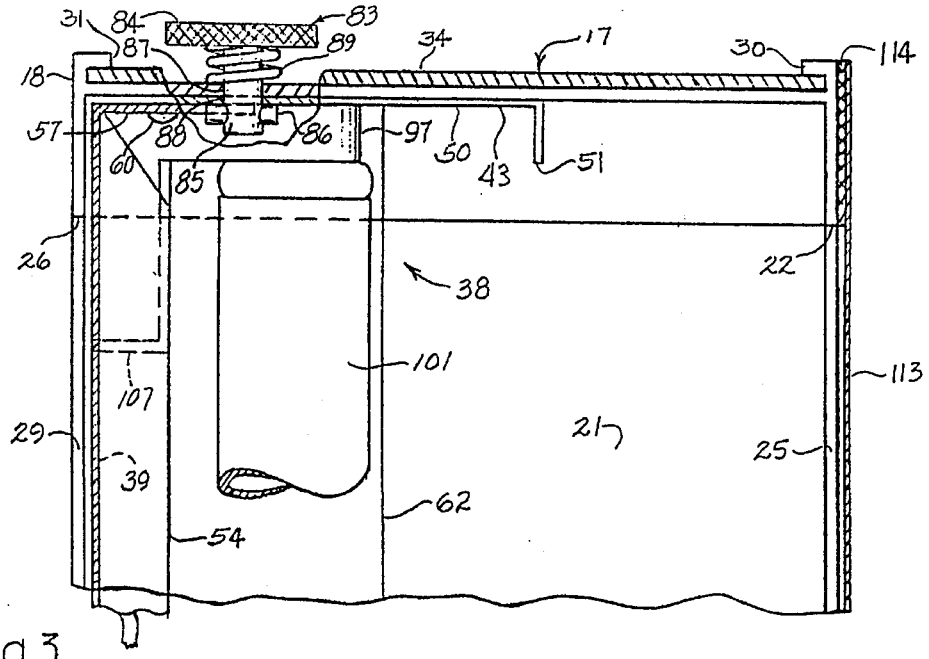
Fig.3
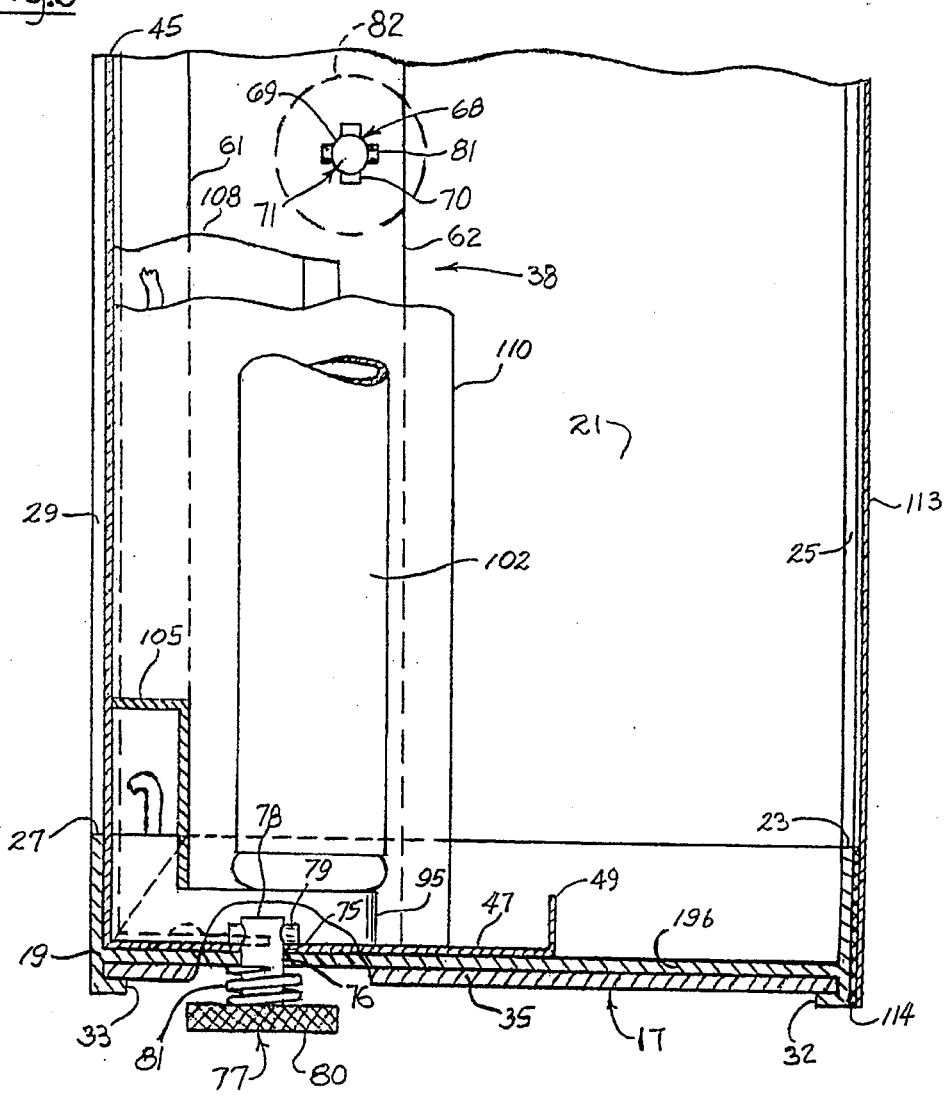

TABLE TOP BACKLIT DISPLAY

BACKGROUND OF THE INVENTION

Field of the Invention

This invention relates to improvements in backlit displays and more particularly to table top backlit displays which are especially well adapted for use in tradeshow display booths.

Description of the Prior Art

Thousands of tradeshows are held annually in the United States, at any one of which anywhere from about two score to hundreds of exhibitors display and promote their products. The format for such shows usually involves the assignment of spaces for exhibit booths which may be 10, 20 or 30 feet in width.

The purpose of the display booth is to provide a place in which vendors can promote their products, services, et cetera to the attendees who are attracted to the booths. To maximize the effectiveness of their efforts, exhibitors go to great lengths to provide attractive displays which draw potential customers thereto and away from their competitors. The most common attention capturing means utilized in display booths is to provide, at the backwall thereof, an exhibit that is unique, is bold in design, and most important, is highly visible.

The tradeshow display booth manufacturing industry is highly developed today. Scores of manufacturers provide light weight backwall units which can be set up in minutes for display thereon of, for example, photographic prints and/or Lexan™ copy panels of all sizes and colors.

Such backwall units commonly employ a flat surfaced panel which is covered with velvet loop-type fabric. The prints or copy panels to be displayed thereon have strips of hook-type fabric bound to the back surface thereof, and they can be firmly but removably attached to the aforementioned panel by simply pressing them onto the loop-type fabric in laminate relation thereto. Since the fabric face and the graphics mounted thereon are quite opaque, they must be illuminated. This is usually done by suspending spotlights above and in front of the panel, such spotlights being oriented for direction of the light therefrom downwardly and rearwardly toward the display.

In order to provide displays with improved attention-getting characteristics, two companies are presently marketing portable displays for ten foot booths which provide back lighting of a translucent fabric or film which bears an attention attracting image on the front face thereof. Both of these displays utilize an eight foot by ten foot rectangular frame of one inch square metal tubing. Mounted across the front of the frame of one of the displays referred to is a white Scanamural™ image bearing fabric, whereas the other type of display utilizes a photographic transparency mounted on a white display panel which extends across the front of the frame thereof.

The first mentioned of these backlit displays employs a silvered reflective fabric attached at its margins to the back of the tubular frame. This fabric is supported with its reflective surface in a concave shape, somewhat like a dome tent, by means of flexible supporting tubes carried by the frame. Mounted in generally centered relation within the dome-like fabric structure are a pair of high intensity halogen lamps oriented to direct their respective outputs toward the reflective surface of the fabric in opposite directions parallel with the image bearing plane. This display is not entirely satisfactory because the central portion of the image receives most of the light and the edges are poorly illuminated.

The other of the available displays aforementioned utilizes a box-like framing system which is about one foot deep. At the rear of this frame four dual fluorescent lamp fixtures are mounted in parallel relation about two feet apart. The lamps of each of these fixtures are parallel with each other and are spaced apart a distance of about three inches. These lamps are also parallel with the image bearing fabric. The sides and back of the frame are covered with aluminized reflective fabric. This type of display is also not entirely satisfactory, due to the fact that the wide spacing between the fixtures produces bright lines in the portions of the transparency image located immediately in front of said fixtures.

In addition to the fact that the described prior art displays exhibit less than desirable illumination of the graphics displayed thereby,they are relatively large. There is need for a backlit display for use in trade shows which is of a size adapted for table top use.

SUMMARY OF THE INVENTION

The present invention provides, in the preferred form thereof, a table top size backlit display which is well adapted for use in trade shows. It is also fabricated of elements which can be readily assembled and disassembled on site, and when disassembled, can be accommodated in a shipping carton of a size acceptable at normal rates by package delivery services. United Parcel Service, for example, accepts at normal rates a shipper (carton) whose length plus girth does not exceed 130 inches.

The present invention provides a backlit display which, in its preferred form, incorporates an articulated lighting assembly having a pair of like lighting units comprising reflective elongated rectangular tray-like members which, in the operative configuration of said assembly, are in spaced side by side generally coplanar and parallel relation. Each of these trays preferably carries three tubular lamps in centered parallel relation thereon, the axes of the lamps being equally spaced apart the presently preferred distance of about 10 inches. The lighting assembly also incorporates an intermediate rectangular reflective panel to which said trays are connected for pivotal movement about axes substantially parallel with the axes of said lamps, when said assembly is in its operative configuration aforementioned, is substantially coplanar with and extends between said trays, the width of said intermediate panel providing, an interaxial distance between the nearest lamps of the two lighting units which is about the same as the space between the axes of adjacent lamps of each unit.

Disposed adjacent an edge portion of each of said trays remote from the edge portion of the respective trays adjacent said intermediate panel is an elongated rectangular reflective auxiliary panel connected to the respective trays for pivotal movement about axes substantially parallel with the axes of said lamps. The width of said auxiliary panels is such that when they are substantially coplanar with the trays of the lighting units in the operative configuration of the lighting assembly, the outer edge portions of said auxiliary panels remote from said trays are spaced from the axis of the outermost lamps a distance which is about half that between the axes of adjacent lamps, for example about 5 inches.

The rectangular trays of the lighting units, the intermediate panel and auxiliary panels extend for substantially the full height of the display, and the trays have mounted at the upper and lower ends thereof receptacles for receiving the ends of and for supporting the aforementioned tubular lamps. Each tray also carries a ballast unit for the lamps supported thereon. The articulated lighting assembly comprising the lighting units, intermediate panel and auxiliary panels, when in its operative configuration, can, as a unit, be readily removably secured within and removed from a rectangular supporting frame having a presently preferred width of about 5 feet and height of about three feet. A pair of broad based tapered supporting members each carry a vertical side member of said frame and together provide a stable base for the display.

The lighting units of the invention, together with the intermediate and auxiliary reflective panels, form a unitary articulated lighting and reflector assembly which, when removed from the supporting frame, is foldable. The supporting members, as well as the lengthwise extending frame members, are preferably sectioned and separable to permit packing of the articulated lighting and reflector assembly, the separable longitudinal frame sections, and the supporting members in a shipper of the type mentioned earlier herein. This permits shipping of the display of the invention from one tradeshow to another at normal package delivery rates and without the need for specialized handling or transporting equipment.

The invention includes a suitable light transmissive image bearing display panel which extends across the front of the frame and overlaps the edges thereof. The display panel may be, for example, an image bearing Roscomural™ or Scanamural™ white vinyl fabric, or a white vinyl fabric on which a Duratrans™ or Ilfochrome™ photographic transparency is mounted, all of which are well known in the art.

The lighting unit trays, intermediate and auxiliary reflective panels, rectangular frame and supporting members, are all preferably made of a light weight metal such as aluminum. The surfaces of said trays and panels which are exposed to the light of the lamps are covered with a white paint which is diffusely reflective of light. The unitary lighting assembly is prewired with appropriate electrical wiring for connecting the lamps thereof with the associated ballasts and with a source of electrical current.

The display of the invention preferably has an illuminated area about 3 feet high and five feet wide. This size permits accommodation, well within the space available in a conventional 10 foot wide tradeshow booth, of the illuminated display, plus various auxiliary non-backlit display panels which can be associated therewith at the top, bottom and/or sides of the illuminate display. When the display of the invention is placed on a table within a tradeshow booth, its illuminated image, disposed generally at eye level, is particularly effective in attracting the attention of attendees passing the booth.

BRIEF DESCRIPTION OF THE DRAWINGS

In the drawings accompanying and forming a part of this application,

FIG. 3 is an enlarged scale fragmentary vertical sectional view taken generally along the stepped line 3—3 of FIG. 1, said figure additionally showing in vertical section a display panel, marginal portions of which are attached to the front of the aforementioned frame;

DESCRIPTION OF THE PREFERRED EMBODIMENT

Figure 4:
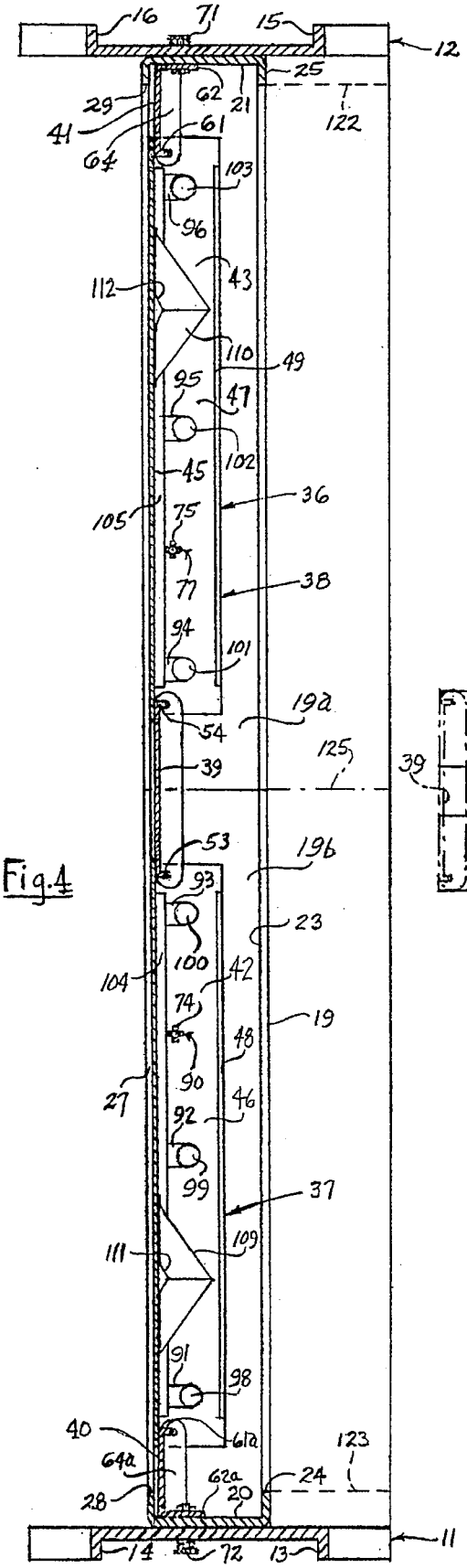
FIG. 4 is a horizontal sectional view taken generality along the line 4—4 of FIG. 1.

Referring now to FIGS. 1 to 4, the numerals 11 and 12 indicate a pair of vertically extending broad based tapered supporting members which respectively have oppositely outwardly facing flanges 13 and 14 and 15 and 16, which are best shown in FIG. 4. Supporting members 11 and 12 support a rectangular frame indicated generally by the numeral 17. The frame 17 comprises horizontal top and bottom members 18 and 19, respectively, and left and right hand vertical side members 20 and 21, respectively. The frame members 18 to 21 are channel shaped and respectively have front flanges 22 to 25 and corresponding rear flanges 26 to 29, best shown in FIGS. 3 and 4.

Figure 1:
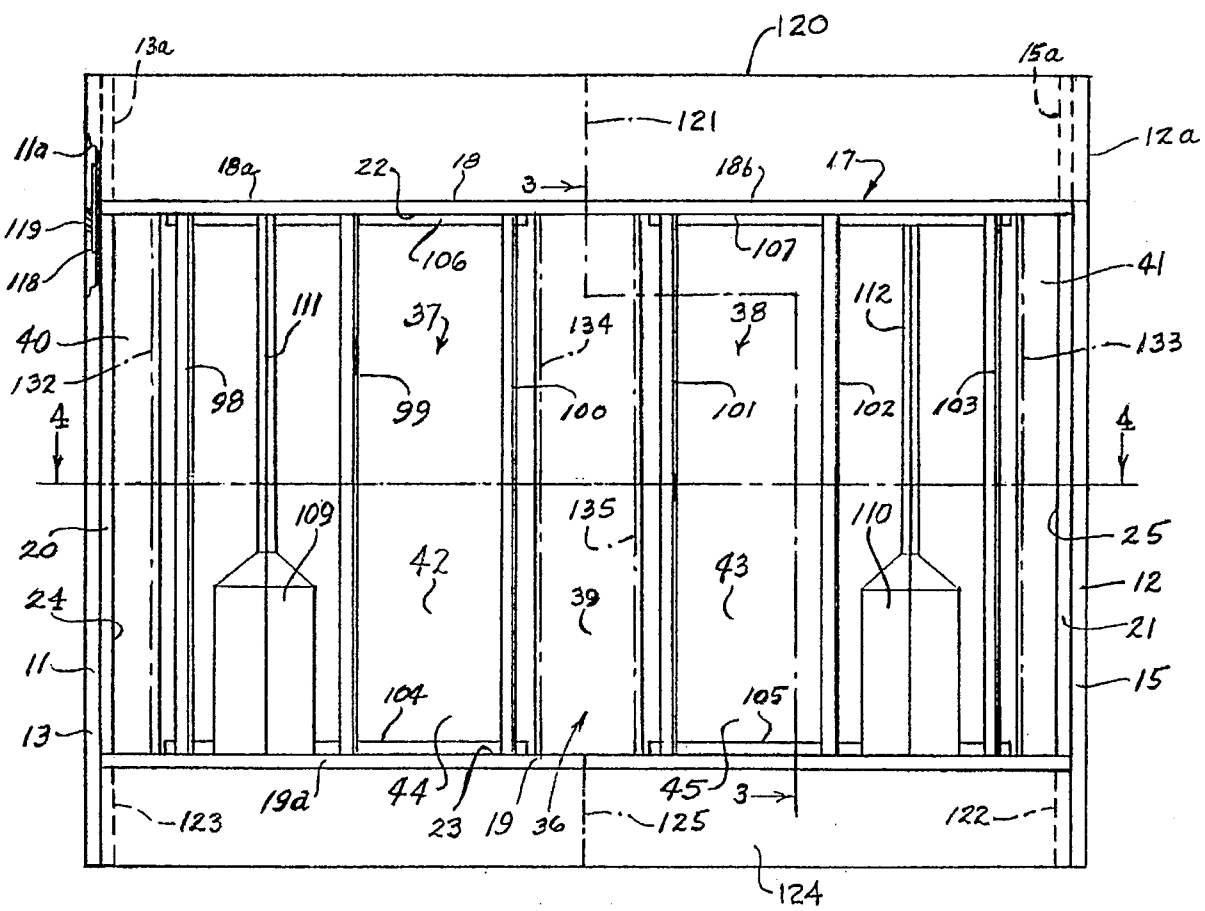
FIG. 1 is a front elevational view of one embodiment of the preferred form of the invention with the light transmissive image bearing display panel removed to expose the articulated lighting and reflector panel assembly therein.

As shown in FIGS. 1 and 4, the upper and lower horizontal frame members 18 and 19 are formed in two generally equal sections 18*a* and 18*b* and 19*a* and 19*b*, respectively. The abutting ends of the sections 18*a* and 18*b*, as well as of sections 19*a* and 19*b* are readily separably joined by connection means which maintains said sections in alignment when joined.

In the illustrated embodiment of the invention, this connection means includes having the upper and lower channel members 18 and 19 formed with the cross sectional shapes illustrated in FIG. 3. As shown in FIG. 3, the flanges 22 and 26 of upper channel 18 project upwardly a short distance beyond the web thereof and terminate, respectively, in short inturned flanges 30 and 31 spaced above and parallel with the web of the member 18. Overlaying and fixed at one end, for example as by welding, to the web of section 18*b* of frame member 18 is a generally rectangular flat bar or tongue member 34. The front and rear margins of bar 34 are engaged beneath the flanges 30 and 31 respectively, as shown. The bar 34 extends into slidable laminate relation with the web of channel section 18*a*, and the front and rear marginal portions thereof are slidably engaged beneath the flanges 30 and 31 of said section.

The front and rear flanges 23 and 27 of lower channel 19 project downwardly a short distance below web of said the channel and terminate in short inturned flanges 32 and 33 which are spaced below and parallel with said web. One end portion of a bar 35 similar to bar 34 underlies the lower surface of the web of the section 19*b* with the front and rear marginal portions thereof engaged under the inturned flanges 32 and 33. Said one end portion of bar 35 is suitably fixed, as by welding, to the web of channel section 19*b*. The bar 35 extends into slidable laminate relation with the web of channel section 19*a*, and the front and rear marginal portions thereof are slidably engaged above the inturned flanges 32 and 33 of said section.

The connection means just described holds the sections 18*a* and 18*b* of channel member 18 and sections 19*a* and 19*b* of channel member 19 in rigid alignment when in the abutting relationship shown in FIGS. 1 and 4. It also permits the respective sections of channel members 18 and 19 to be separably disconnected by longitudinal movement away from each other sufficient to withdraw the bars 34 and 35 from the sections 18*b* and 19*b*, respectively.

The vertical side members 20 and 21 of the rectangular frame 17 are fixed to the inner surfaces of the tapered supporting members 11 and 12, respectively, as by rivets (not shown), or other suitable means. As shown in FIG. 1, the opposite ends of the horizontal upper frame member 18 overlay the upper ends of the vertical frame side members 20 and 21 and are in registration therewith. Similarly, the opposite ends of the horizontal lower frame member 19 underlay and are in registration with the lower ends of the vertical frame side members 20 and 21. With this arrangement, the front surfaces of the flanges 22 to 25 of frame 18 to 21, respectively, are in substantially coplanar relation, and the bottom frame member 19 is spaced above the plane of the bottoms of the supporting members 11 and 12 the presently preferred distance of about 6 inches.

Removably supported within the rectangular frame 17 is a unitary articulated lighting and reflector assembly 36 best shown in FIGS. 1 and 4. This assembly comprises a pair of spaced similar lighting and reflector units 37 and 38, an intermediate reflector panel 39 linking the units 37 and 38, and a pair of auxiliary reflector panels 40 and 41 linked respectively to the left hand end of the unit 37 and the right hand end of the unit 38.

The units 37 and 38 comprise supporting tray members 42 and 43, respectively, which have elongated planar rectangular main or back wall portions 44 and 45, respectively. A rectangular shelf 46 projects from the lower edge portion of the back wall 44 of tray 42 in a direction normal to the latter. A similar rectangular shelf 47 projects from the lower edge portion of the back wall 45 of the tray 43 and is normal thereto. The outer edges of the shelves 46 and 47 terminate in upturned flanges 48 and 49, respectively.

Projecting from the upper edge portions of the back walls 44 and 45 of trays 42 and 43 are upper shelves corresponding to the lower shelves 46 and 47. The upper shelf of the tray 42 is not shown on the drawings, but the upper shelf 50 of the tray 43 is shown on FIG. 3. A flange 51 projects downwardly from the outer edge portion of the shelf 50. As best shown on FIG. 4, the upturned flanges 48 and 49 on shelves 46 and 47, respectively terminate short of the adjacent end portions of said shelves for a reason which will hereinafter appear. The down turned flanges on the upper shelves of the trays 42 and 43 are similarly configured.

Figure 6:
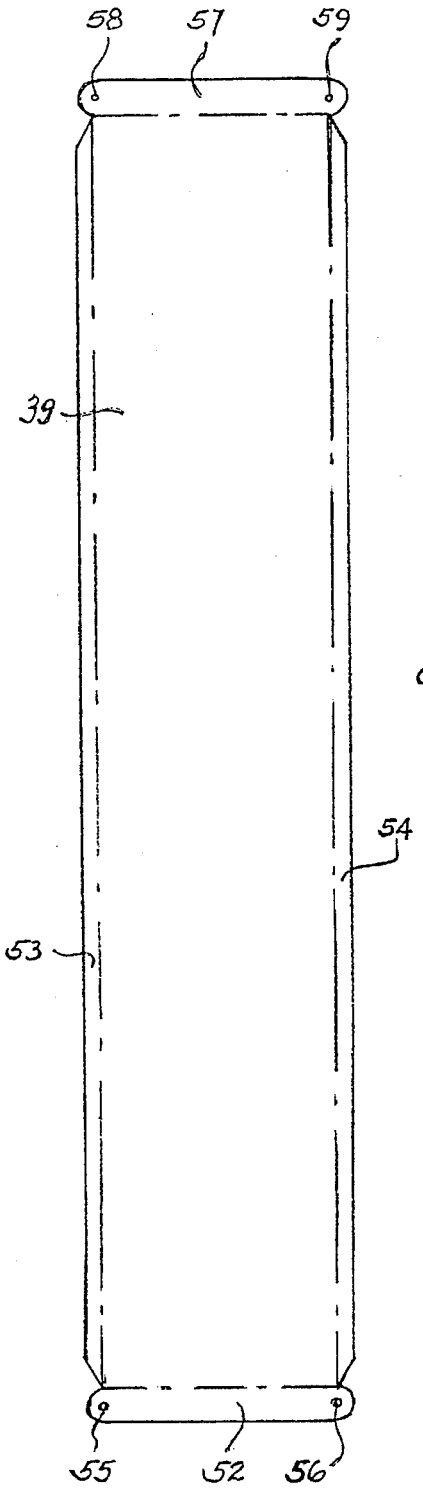
FIGS. 6 and 7 illustrate the shapes of sheet metal blanks from which the intermediate and auxiliary reflective panels can be made, respectively.

The configuration of the intermediate panel 39 can perhaps best be understood by reference to FIG. 6 which illustrates a sheet metal blank from which said panel can be formed. In FIG. 6, the dot and dash lines indicate bend lines along which the marginal portions outwardly thereof are bent in the same direction normal to the main wall portion of said panel. In FIG. 6, the marginal portions of the blank are bent toward the viewer. The marginal portion 52 at the lower end of the blank is formed with circular apertures as at 55 and 56. The marginal portion 57 at the upper end of the blank is formed with circular apertures 58 and 59. The narrow marginal portions 53 and 54 of the panel 39, when bent normal to said panel as described, provide stiffening ribs or flanges best shown in FIG. 4.

The marginal side portions of the panel 39 bearing the flanges 53 and 54 are disposed in overlapping relation in front of the adjacent edge portions of the main wall portions 44 and 45 of trays 42 and 43, respectively, as shown in FIG. 4. The apertured lower and upper flange portions 52 and 56 of the panel 39 respectively overlay and underlay the lower and upper surfaces of the lower and upper shelves of the trays 42 and 43, respectively. Suitable pivot pins (not shown) project through the circular apertures 55 and 56 in the opposite ends of the lower flange 52, and the lower shelves 46 and 47 of trays 42 and 43 are formed with circular apertures (not shown) in registration with apertures 55 and 56 and in which such pivot pins are received.

Similarly, suitable pivot pins extend through the apertures 58 and 59 in the upper flange 57 of the panel 39, and the adjacent portions of the upper shelves of the trays 42 and 43 are formed with circular apertures in registration with those of the flange 57 and receive pivot pins (not shown) projecting therethrough. In the upper portion of FIG. 3 a pivot pin 60 is illustrated, along with the upper flange 57 of the intermediate panel 39. In FIG. 4, the pivot pins through the end portions of the flange 52 are obscured by the flanges 53 and 54 of the panel 39.

Figure 7:
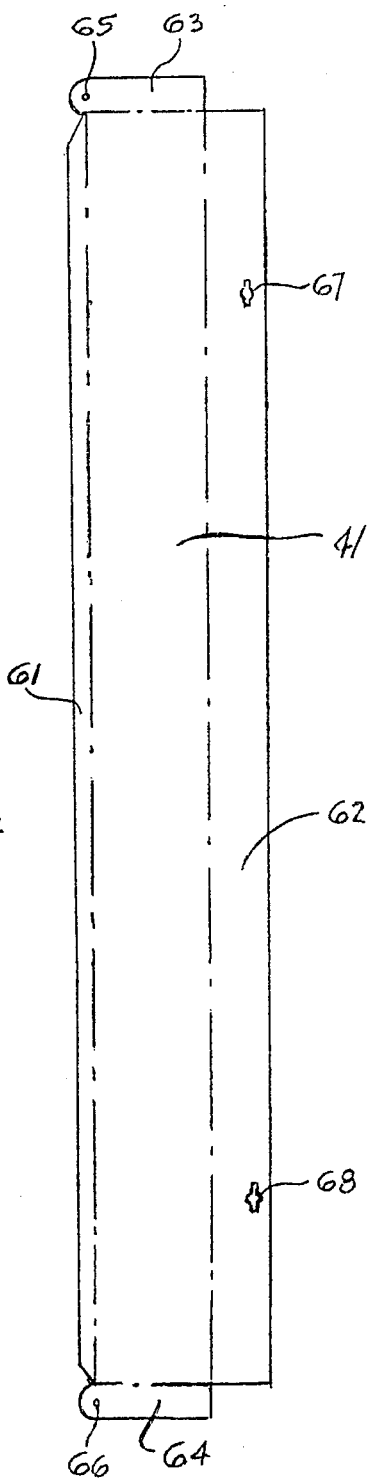

The configuration of the auxiliary reflecting panels 40 and 41 can best be understood by reference to FIG. 7 which illustrates a blank from which such auxiliary panels can be formed. The dot and dash lines indicate the bend lines along which the marginal portions outwardly thereof are bent in the same direction normal to the main body portion of said panel.

As shown in FIG. 4, the left hand marginal portion of the panel 41 is in overlaying relation in front of the right hand marginal portion of the main or back wall 45 of tray 43. The left hand end of lower flange 64 of panel 41 is formed with a circular aperture 66 (FIG. 7), and overlays the adjacent end portion of the lower shelf 47 of tray 43. The shelf 47 is formed with a circular aperture in registration with the aperture 66 in the flange 64, and a pivot pin (not shown) extends through said apertures.

The upper flange 63 of the panel 41 is in underlying contact with the upper shelf 50 of tray 43 which, in turn, is formed with a circular aperture in registration with the aperture 65 in flange 63 and receives a pivot pin (not shown) which extends through both apertures. The flange 62 of the panel 41 overlays the inner surface of the web of the side frame channel member 21 as shown in FIG. 4.

The left hand auxiliary reflecting panel 40 is substantially identical with the panel 41 illustrated in FIG. 7, but is inverted. Panel 40 has flanges 61*a*, 62*a* and 64*a* which correspond with the flanges 61, 62 and 64 of panel 41. As shown in FIG. 4, the flange 62*a* of the panel 40 overlays the inner surface of the web of the side frame channel member 20. It will be understood that the panel 40 is pivotally connected to the lower and upper shelves of tray 42 by pins (not shown) extending through suitable apertures in said shelves in registration with those in the end flanges of said panel.

Referring to FIG. 7, the flange 62 of the panel 41 is formed with identical keyhole shaped apertures 67 and 68 which are generally equally spaced from the ends of said flange. The flange 62*a* of panel 40 is formed with apertures (not shown) substantially identical with apertures 67 and 68. As best shown on an enlarged scale in FIG. 3, the keyhole type aperture 68 in flange 62 has a central circular portion 69 and a generally rectangular diametrical slot portion 70. The opposite end portions of slot 70 project from diametrically opposite sides of the circular portion 69 as shown. The other aperture 67 in flange 62, as well as the corresponding apertures (not shown) in flange 62*a* of panel 40, preferably have a keyhole type configuration identical with that of the aperture 68 shown in FIG. 3.

The web of the right side frame channel 21 and the web of the supporting member 12 are formed with apertures (not shown) preferable identical with the aperture 68 and respectively in registration with the apertures 67 and 68 in flange 62. Similarly, the web of the left side channel member 20, as well as the web of the supporting member 11, are formed with apertures preferably identical with the apertures 67 and 68, said apertures being in registration with the apertures of flange 62*a* (not shown) and are in registration with the latter.

Quarter turn connectors 71 and 72, shown in FIG. 4, have a structure which will be described hereinafter. The connector 71 extends through the aperture 68 and through the registering apertures (not shown) in the webs of the channel member 21 and the supporting member 12. The connector 72 extends through the aperture in the flange 62*a* corresponding to aperture 68, and through the webs of channel 20 and the supporting member 11. Such connectors function to hold the flange, and the webs through which they pass in compressive laminate relation. The connector 71 is also identified in FIG. 2, and the connector which passes through the upper aperture 67 of flange 62*a* and through the webs of channel 20 and supporting member 11 is identified in FIG. 2 by the numeral 73.

Referring now to FIG. 4, the lower shelves 46 and 47 of the trays 42 and 43 are formed with keyhole type apertures 74 and 75 which are preferably identical with the aperture 68 shown in FIG. 3. As best shown in FIG. 3, the lower shelf 47 of tray 43 overlays the upper surface of the web of the section 19*b* of the horizontal lower frame member 19, and the upper surface of the upper shelf 50 of the tray 43 underlies the under surface of the web of the section 18*b* of the horizontal upper frame member 18.

A spring loaded quarter turn type connector 77 which is the same as connectors 71 and 72 in FIG. 4 mentioned earlier herein, has a cylindrical stem 78 which has a sliding fit within the circular portions of the registering apertures 75 and 76. Stem 78 carries at its inner end a transverse cylindrical pin 79 which extends diametrically therethrough and is sized to pass freely through the rectangular slot portions of the registering apertures 75 and 76. The stem 78 carries at its outer end below the horizontal lower frame member 19 a knurled circular head or knob 80. A helical compression spring 81 surrounds the stem 78 and is interposed between the web of the lower frame section member 19*b* and the head 80 of the connector 77. The spring 81 biases the head 80 outwardly, i.e., downwardly.

With further reference to FIG. 3, the operation of the quarter turn connectors illustrated in the drawings will be better understood by reference to the connector 71 which carries at the inner end of its cylindrical stem the diametrical cylindrical pin 81.

The cylindrical stem of connector 71 can be readily inserted through the aperture 68 when the diametrical pin 81 is aligned with the rectangular slot 70. The helical compression spring surrounding said stem is compressed by such movement, and after the diametrical pin 81 has passed inwardly beyond the surface of the flange 62, the knob 82, and thereby diametrical pin 81 is rotated about one quarter turn to the position thereof shown in FIG. 3, after which the knob 82 is released. Upon release of the knob 82, the compression spring surrounding the stem biases said knob outwardly to thereby bias the diametrical pin firmly against the inner surface of the flange 62 and hold said flange, the web of the channel 21 and the web of the supporting member 12 firmly in compressive laminate relation.

In vertical alignment with the connector 77 and substantially identical with the latter is a connector 83 which is also shown in FIG. 3. The connector 83 has a knurled head 84, a cylindrical stem 85 and a diametrical pin 86. The stem 85 and pin 86 pass freely through keyhole type apertures 87 and 88 through the web of the upper frame section 18*b* and the upper shelf 50 of tray 42. The apertures 87 and 88 are identical with the apertures 76 and 75 in which the connector 77 is disposed, as well as being identical with the aperture 68 also shown in FIG. 3.

The connector 83 functions to hold the upper shelf 50 and the web of the upper frame member 18*b* firmly in compressed laminate relation by virtue of the bias of the helical spring 89 surrounding the stem 85 between said web and the head 84 of the connector. It will be understood that all of the quarter turn connectors employed in the invention can be substantial identical in structure and function. The same is true of the key hole type apertures through which the stems of said connectors extend.

The stem of connector 90 extends through the aperture 74 through the lower shelf 46 of tray 42 and through an identical aperture (not shown) in the web of the lower horizontal frame section 19*a*, to hold said shelf and web in compressive laminate relation. Further, in vertical alignment with the connector 90 and aperture 74, there is a quarter turn connector (not shown) which has the same relationship with the upper shelf of the tray 42 and the upper frame section 18*a* shown in FIG. 1. There is also a quarter turn connector (not shown) vertically aligned with connector 72 shown in FIG. 4 which passes through aligned keyhole type apertures (not shown) in flange 62*a* and the web of the supporting member 11.

It is apparent from the foregoing that the structure thus far described is held in assembled relationship from which it can be quickly disassembled, by eight spring loaded quarter turn connectors. More specifically, the connectors 77 and 90 bind the lower shelves 47 and 46 of the trays 43 and 42 to sections 19*b* and 19*a* of the lower horizontal frame member 19. Similarly, the connector 83 and the connector in vertical alignment with the connector 90 (not shown), respectively bind the upper shelf 50 of tray 43 and the upper shelf (not shown) of the tray 42 to the sections 18*b* and 18*a* of the upper horizontal frame member 18. The connectors 71 and 73 bind the flange 62 of auxiliary reflector panel 41 to the right vertical frame member 21 and supporting member 12. The connector 72 and the connector vertical alignment thereabove (not shown) bind the flange 62*a* of auxiliary reflector panel 40 to the left vertical frame member 20 and to the supporting member 11.

Referring now to FIGS. 1, 3 and 4, three tubular lamp receptacles 91, 92 and 93 are mounted in equally spaced relationship on the lower shelf 46 of tray 42, and three equally spaced tubular lamp receptacles 94, 95 and 96 are mounted on the lower shelf 47 of the tray 43. The presently preferred spacing between the axes of adjacent receptacles 91 to 96 is about 10 inches, and the presently preferred spacing between the axes of receptacles 91 and 96 and the flanges 62*a* and 62, respectively, is one half the distance between the axes of adjacent lamp receptacles, i.e., about 5 inches.

Three equally spaced tubular lamp receptacles (not shown) are mounted on the underside of the upper shelf (not shown) of tray 42 in vertical alignment, respectively, with the receptacles 91, 92 and 93. Similarly, three equally spaced tubular lamp receptacles are mounted on the under surface of the upper shelf 50 of tray 43. One of these receptacles is shown in FIG. 3 and is identified by the number 97, said receptacle being in vertical alignment with the receptacle 94 therebelow. The other two receptacles are not shown in the drawing but are in vertical alignment respectively with receptacles 95 and 96.

Six spaced parallel preferably fluorescent tubular lamps numbered 98 to 103 have their lower ends received respectively in the lower receptacles 91 to 96 and have their upper ends received in the aforementioned upper receptacles which are in vertical alignment with receptacles 91 to 96. The lamps presently preferred for use in the lighting and reflector units 37 and 38 are one inch in diameter and thirty six inches in length. Such lamps are available from the Osram Corporation, 110 Bracken Road, Montgomery, N.Y. 12549 as OSRAM® T8/FO 25 Watt Trichrome Fluorescent Lamps.

The lighting and reflector units 37 and 38 of the assembly 36 are prewired, the wiring connecting the lower receptacles of the unit 37 being accommodated in a rectangular duct 104. The wiring connecting the lower receptacles of the unit 38 is accommodated in a rectangular duct 105. The wiring connecting the upper receptacles of the unit 37 is accommodated within a rectangular duct 106, and the wiring connecting the upper receptacles of the unit 38 is accommodated within a rectangular duct 107.

Each of the units 37 and 38 has its own, preferably electronic, ballast. The ballast for the unit 38 is shown in FIG. 3 and is identified by the numeral 108. It is enclosed within a light shield 110 as shown in FIG. 3. The ballast (not shown) for the unit 37 is enclosed within a light shield 109, which, like the light shield 110, is generally triangular in cross section as best shown in FIGS. 1 and 4. A vertical wiring duct 111 of generally triangular cross section accommodates the wiring connecting the lower receptacles and ballast of the unit 37 with the upper receptacles thereof. A similar vertical wiring duct 112 accommodates the wiring connecting the lower receptacles and ballast of the unit 38 with the upper receptacles thereof. Suitable connection means (not shown) is provided to connect units 37 and 38 with a source of electrical current.

Referring now to FIG. 1, the frame members 18 to 21 define a rectangular opening therewithin, and the front surfaces of the front flanges 22 to 25 of said frame members, respectively, are coplanar. The rectangular frame 17 is formed by said frame members, and a preferably correspondingly sized and shaped rectangular light transmissive image bearing display panel 113 shown in FIG. 3 is removably mounted on the front of said frame. The display panel 113 may take a variety of suitable forms. It may, for example, take the form of a flexible white vinyl sheet or fabric, and the image borne thereby may take the form of paint applied directly thereto, or the alternative form of a photographic transparency bonded thereto.

The means for mounting the display panel on the front surfaces of the frame 17 may also take a variety of suitable forms. The presently preferred mounting means takes the form of hook fastener strips coextensive with and bonded to the front surfaces of the frame sections 18*a*, 18*b*, 19*a*, 19*b* and of the vertical side frame members 20 and 21, all shown in FIG. 1. The marginal portions of the display panel 113 have bonded to the back thereof loop fastener strips, the loops of which interengage with the hook fastener strips on the frame 17 when edge portions of the display panel 113 are pressed against the latter. In FIG. 3, the interengaged velvet loop fastener strips and hook fastener strips are indicated by the numeral 114. Cooperable hook and loop fastening means of the type described are well known in the art and are available from a number of commercial sources. Any other suitable releasable connection means may be used in place of the presently preferred hook and loop connection means shown and described herein.

Referring again to FIGS. 1 and 2, the broad based tapered supporting member 12 comprises a removable upper end section 12*a*, the lower end of which has a configuration identical with the upper end of the main portion of member 12 and is in registration with the latter. Any suitable releasable connection means may be used for attachment of the section 12*a* to the main portion of the member 12.

In the illustrated embodiment, this connection means takes the form of a bar or tongue 115, the upper end of which overlies and is rigidly attached to the web of the section 12*a*, for example by rivets (not shown). A metal strap 116 having a generally U-shaped configuration in plan view is secured to the web of the main portion of the supporting member 12 by suitable means (not shown) such as riveting. The flat central portion 117 of the strap 116 is spaced from the web of the supporting member 12 by an amount sufficient to permit accommodation therewithin of the bar or tongue 115 with a snug sliding fit into and out of the position shown in FIG. 2.

The left-hand broad based tapered supporting member 11 has a removable upper end section 11*a* which may be identical with the upper end section 12*a* of the supporting member 12. A bar or tongue 118 corresponding to the bar or tongue 115 on Section 12*a* is fixed, as by riveting (not shown), to the web of the section 11*a*. A horizontal metal strap 119, corresponding to the metal strap 116, has its ends fixed, as by riveting, to the web of the main section of the supporting member 11 and has a central portion spaced from said web to provide for accommodation of the tongue or bar 118 therewithin with a snug sliding fit.

Figure 8:
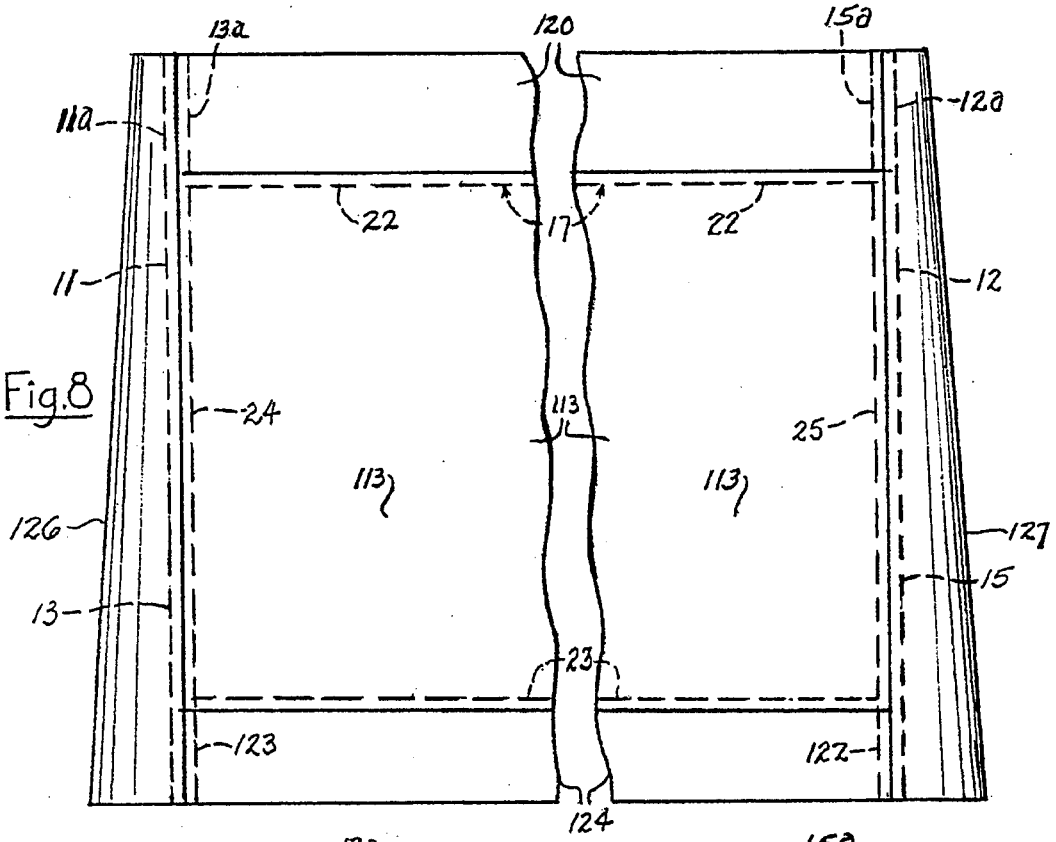
FIG. 8 is a fragmentary front elevational view of a modified form of the invention in which each of the supporting members has a semiconical decorative end panel attached thereto.
Figure 9:
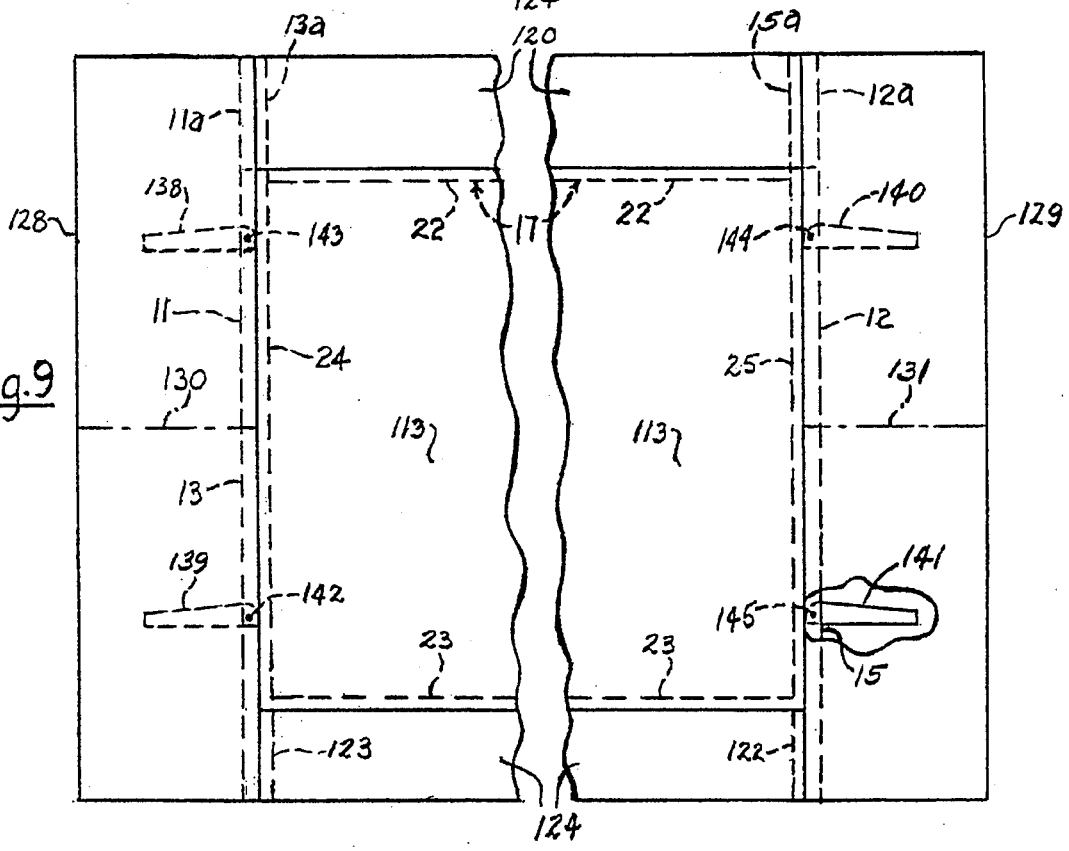
FIG. 9 is a fragmentary front elevational view of another modified form of the invention in which auxiliary side display panels are attached to and extend in opposite directions outwardly from the supporting members.

As shown in broken lines in FIGS. 1, 8 and 9, the upper end section 11*a* of the supporting member 11 is provided with an integral flange 13*a* which is in alignment with the portion of the flange 13 thereon and projects from the web of said section in the normal direction opposite that of flange 13. The front faces of flanges 13 and 13*a* are generally coplanar.

The upper end section 12*a* of supporting member 12 is similarly provided with an integral flange 15*a* which is in alignment with the portion of the flange 15 thereon and projects from the web of said section in the normal direction opposite that of flange 15. The front faces of flanges 15 and 15*a* are generally coplanar.

The front face of the portion of the flange 15 on the section 12*a*, as well as the front face of the flange 15*a*, are each preferably coextensively overlaid with a hook fastener strip (not shown) which is bonded thereto. The front face of the portion of flange 13 on the upper section 11*a* of supporting member 11, as well as the front face of the flange 13*a*, are each also preferably coextensively overlaid with a hook fastener strip (not shown) which is bonded thereto.

Suitably mounted on the inner surface of the right hand supporting member 15 is a flange 122 which projects normal thereto and extends from the lower front corner of the rectangular frame 17 downwardly and forwardly to the bottom of said supporting member adjacent the front flange 15. Similarly attached to the inner surface of the left-hand supporting member 11 is a flange 123 which projects normal thereto and is aligned in opposing relationship with the flange 122. The front face of each of the flanges 122 and 123 preferably has a hook fastener strip (not shown) coextensively overlaying the same and bonded thereto.

Figure 2:
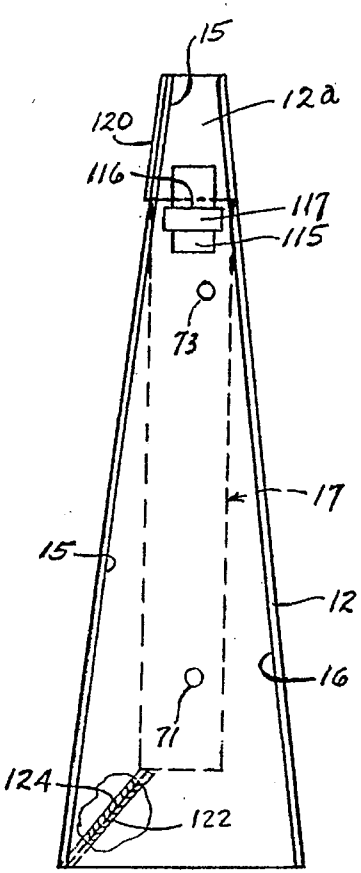
FIG. 2 is an elevational view of the right hand end of the form of the invention shown in FIG. 1, the rectangular outline of the adjacent end of the frame thereof being shown in broken lines.

An elongated rectangular header panel 120 is supported above the frame 17, and a similar elongated rectangular subheader panel 124 is supported below the frame 17 as shown in FIGS. 1 and 2. These panels are preferably clad on both sides with velvet loop type fabric.

The loop fabric at the marginal left-hand end portions on the back of panel 120 are pressed into interengagement with the hook fastener strips on the flanges 13 and 13*a*, and those on the right-hand end are pressed into interengagement with the hook fastener strips on the flanges 15 and 15*a*. The loop fabric at the marginal left-hand end portions on the back of panel 124 are similarly pressed into interengagement with the hook fastener strips on the flange 123, and those on the right-hand end are pressed into interengagement with the hook fastener strips on the flange 122.

The panels 120 and 124 are thus rigidly but releasably held in the operative positions thereof shown in FIGS. 1 and 2. These panels are typically each fabricated from a pair of similarly sized rectangular sheets of rigid light weight fiber glass, and the velvet loop fabric with which both sheets are clad serves as a hinge means permitting folding thereof, for example along the fold lines 121 and 125 shown in FIG. 1.

The header panel 120 and the subheader panel 124, when installed in the operative positions shown in FIG. 1, are ready to be fitted with appropriate copy panels (not shown). Typical copy panels are long rectangles of transparent polycarbonate sheets to which text is applied by screen printing, as by laminating thereto computer cut vinyl lettering. A subsequent paint coating on the rear surface of the polycarbonate sheets provides a desired background color. Hook fastening strips bound to the marginal rear surface portions of the copy panels securely but releasably anchor these copy panels to the respective headers and subheader panels when pressed into interengagement with the velvet loop fabric cladding said panels. Such graphic copy materials are quite flexible, and when elongated in shape are rollable for storage and shipping purposes.

FIG. 8 is a front elevation similar to FIG. 1, but illustrates the display panel 113 mounted on the front of the frame 17. In the form of the invention shown in FIG. 8, the full length of the front surfaces of the flanges 13 and 15 of the supporting members 11 and 12, as well as the full length of the rear surfaces of the rear flanges 14 and 16 (not shown) of said members, are coextensively overlaid with hook fastener strip material (not shown) which is bonded thereto. In FIG. 8, a pair of similar semiconical panels 126 and 127, which may be formed of flexible polycarbonate sheets clad with velvet loop type fabric (not shown), are removably attached to the supports 11 and 12, respectively. Panels 126 and 127 have the velvet loop type fabric on the inner side margins thereof which overlay and are interengaged with the hook fastener strips on the respective flanges 13, 14, 15 and 16 when pressed against the latter. The panels 126 and 127 project laterally outwardly from supporting members 11 and 12, respectively, as shown, and are readily removable therefrom, by grasping a lower corner and peeling the respective panel upwardly and away from the supporting member from which it is to be removed.

Since the panels 126 and 127, when in the operative positions shown in FIG. 8, are bound to flanges 13 and 16 as aforementioned, the header panel 120 used herewith is somewhat shorter than that shown in FIG. 1, and said header panel has the velvet loop fabric on its marginal back end surfaces interengageable with the hook fastener strips on the flanges 13*a* and 15*a* only.

FIG. 9 illustrates a structure similar to that shown in FIG. 8, except that the semiconical panels 126 and 127 of FIG. 8 are replaced by velvet loop clad elongated flat substantially rectangular panels 128 and 129 which are of a construction similar to those of the header and subheader panels 120 and 124. The side marginal portions of the velvet loop type fabric on panels 128 and 129 are removably interengageable with the hook fastener strips on the front flanges 13 and 15 of the support members 11 and 12, respectively. The panels 128 and 129 are also foldable, for example, along the dot and dash fold lines 130 and 131, respectively.

In order to provide support for the flat panels 128 and 129, the supporting members 11 and 12 are provided with suitable supporting bracket means. In the embodiment of the invention illustrated in FIG. 9 this means takes the form of a pair of elongated brackets 138 and 139 mounted on the back face of the front flange 13 of supporting member 11, and similar brackets 140 and 141 mounted on the back face of the front flange 15 of supporting member 12.

The brackets 140 to 145 are connected to their supporting flanges by pivot means 142, 143, 144 and 145, respectively, and are swingable between the generally horizontal operative positions shown in FIG. 9 and raised storage or shipping positions (not shown) in which said brackets are aligned behind the respective supporting flanges. Brackets 138 to 144 preferably have hook fastener strips (not shown) bound to the front surface thereof, which strips interengage with the loop type fabric on the back side of the respective panels 128 and 129 to stabilize the latter when they are in the operative positions shown in FIG. 9.

Since the semiconical panels 126 and 127, as well as the flat panels 128 and 129, are covered with velvet loop type connector fabric, graphics (not shown) backed with hook type connector strips can be applied thereto and will remain attached thereto until removed. The graphics applicable to the panels 126, 127, and 128 and 129, as well as the those applicable to panels 120 and 124, augment the display afforded by illumination of the display panel 113.

The structure disclosed in FIGS. 1 to 4, 8 and 9 can be quickly and easily disassembled and packed for shipping in cartons acceptable at normal rates by package delivery services. An example of a shipping carton whose dimensions are within the limits for normal rates set by the United Parcel service is one which is 25 inches wide, 18 inches thick and 43 inches deep. The girth plus length of such a carton equals 129 inches.

The dimensions of the components of the presently preferred embodiment of the structure hereinbefore described are such that they easily can be accommodated within a shipper having the aforementioned dimensions. The tapered supporting members 11 and 12 with the upper sections 11*a* and 12*a* removed, are preferably about 42 inches long. The sections 18*a* and 18*b* and 19*a* and 19*b* of the horizontal upper and lower members 18 and 19 of the frame 17 are preferably about 5 inches wide and about 30 inches long, and the bars or tongues 34 and 35 preferably project from the ends of the sections 18*b* and 19*b* no more than about 6 inches, so that the overall length of the sections 18*b* and 19*b*, including projecting portions of the bars 34 and 35, is about 36 inches.

Correspondingly, the overall length of the header and subheader panels 120 and 124 is preferably about 60 inches, so that when these panels are folded along the fold lines 121 and 125, respectively, their length is about 30 inches, width is about 8 inches, and the thickness of each is about ½ inch. The overall length of the flat panels 128 and 129 is preferably about 51 inches, so that when these panels are folded along the fold lines 130 and 131, respectively, their length is about 25½ inches, width is about 15 inches, and the thickness of each is about ½ inch. Further, the display panel 113 in unmounted condition is rollable in the direction of its length, as are the flexible panels 126 and 127, and combined, provide a roll which is preferably about 36 inches long and about 8 inches in diameter.

The backlit display of the invention, when in use, is preferably supported on an elongated rectangular table (not shown), for example a table which is about 30 inches high, about 3 feet wide and from about 7 to about 10 feet long. A display as disclosed herein, when arranged on a such table extending across the back wall of a tradeshow booth, is remarkably effective in attracting the attention of tradeshow attendees passing the booth. This is because of the bright and generally uniform illumination of the image on display panel 113, and also because the illuminated image is entirely located at generally eye level.

Disassembly of the display of the invention can be accomplished quickly and easily, as follows. First of all, any supplementary graphics applied to the header or subheader panels 120 and 124, and to panels 126, 127, 128 or 129 are removed by grasping one corner thereof and peeling the same from the respective panel or panels. Next, the flexible display panel 113 is removed from the frame 17 by grasping a corner thereof and peeling the same away from said frame.

The header panel 120 is then peeled away from the front flanges of upper sections 11*a* and 12*a* of the supporting members 11 and 12, respectively, and the subheader panel 124 is similarly peeled away from the flanges 122 and 123 on the supporting members 11 and 12, respectively. Then, the semiconical panels 126 and 127 or the flat panels 128 and 129, if used, are removed by grasping a lower corner thereof and peeling the same away from the respective supporting member 11 or 12, both front and rear for the panels 126 and 127, and front only for panels 128 and 129.

The flexible semiconical panels 126 and 127, upon removal, assume a flat sheet configuration and are then rolled with the display panel 113. Upon removal of the flat panels 128 and 129, the brackets 138 to 141 are swung upwardly into parallelism with their supporting flanges.

Upon removal of the header and subheader panels 120 and 124, and of the flat panels 128 and 129, each of said panels is folded along its indicated fold line for readiness in packing. The upper sections 11*a* and 12*a* are then removed from the supporting members 11 and 12, respectively, by lifting said sections vertically to withdraw the bars or blades 118 and 115 from within the straps 119 and 116, respectively. These sections are together set aside for readiness for packing.

The structure remaining is then placed transversely on the aforementioned table with the frame 17 lying flat thereon and overhanging the opposite side edges thereof so that the supporting members 11 and 12 are spaced beyond said side edges. The member 12 and the side frame channel member 21 fixed thereto are then removed from the assemblage by turning the connector 71, shown in FIGS. 3 and 4, and connector 73, shown in FIG. 2, one quarter turn and withdrawing the same from the keyhole type apertures in which they were located. This frees the supporting member 12 and frame side member 21 fixed thereto from the auxiliary reflector panel 41 of the right hand lighting and reflector unit 38 of the assembly 36 and permits said supporting member and frame side member to be removed and set aside for packing.

The connector 72, shown in FIG. 4, and the connector (not shown) in vertical alignment therewith are then each turned one quarter turn and withdrawn from the keyhole apertures in which they were located. This frees the supporting member 11 and frame side member 20 fixed thereto, from the auxiliary reflector panel 40 of the lighting and reflector unit 37 of the assembly 36 and permits said supporting member and frame side member to be removed and set aside with the supporting member 12 for packing as a matched pair.

Next, the connector 77, shown in FIGS. 3 and 4, and the connector 90 shown in FIG. 4, which extend, respectively through the webs of the sections 19*b* and 19*a* of lower frame member 19, as well as through the lower shelves 47 and 46 of the lighting and reflector units 38 and 37, are then rotated one quarter turn and withdrawn from the keyhole type apertures in which they were located. This frees the lower horizontal frame member 17 from the lower shelves 46 and 47 and thereby from the lighting and reflector units 37 and 38, respectively.

The connector 84 shown in FIG. 3 extending through the web of section 18*b* of upper frame member 18 and through the upper shelf 50 of the tray 43, and the corresponding connector (not shown) extending through the web of section 18*a* of upper frame member 18 and through the upper shelf of the tray 42 in vertical alignment with the connector 90, are then turned one quarter turn and withdrawn from the keyhole type apertures in which they were located. This releases the upper frame member 18 from the respective upper shelves of trays 42 and 43 and thereby from the lighting and reflector units 37 and 38 of assembly 36.

The sections 18*a* and 18*b* of the frame member 18 are then separated by pulling the same in opposite longitudinal directions sufficient to withdraw the bar or tongue 34 of the frame section 18*b* from the frame section 18*a*. The sections 19*a* and 19*b* of frame member 19 are then separated in the similar manner to withdraw the bar or tongue 35 of frame section 19*b* from frame section 19*a*. The sections 18*a*, 18*b*, 19*a* and 19*b* are then set aside in alignment one behind the other in readiness for packing.

What is left on the table is the articulated lighting and reflector assembly 36 in its operative configuration, which is best shown in the horizontal section in FIG. 4. As it lies flat upon the table 1 the assembly 36 is opened to its fullest extent, with the tray main walls 44 and 45, intermediate panel 39 and auxiliary reflective panels 40 and 41 in generally coplanar alignment. In this assemblage the lower flange 52 of the intermediate panel 39, and the corresponding upper flange 57 of said panel, which is illustrated along with lower flange 52 in FIG. 6, both serve as links which are pivotally connected at their ends to the lower and upper shelves, respectively, of the lighting and reflector units 37 and 38.

The lower and upper end portions of the auxiliary reflector panel 41, shown in FIG. 7, which are the flanges 64 and 63, respectively, and the pivot pins extending through the apertures 66 and 65 thereof, and through the registering apertures in the shelves of tray 43, provide a pivotal mounting for the auxiliary reflector panel 41. The lower and upper end portions of the auxiliary reflector panel 40 which are the lower flange 64*a* and the upper flange (not shown) of panel 40, and the pivot pins (not shown) extending through the apertures (not shown) in said flanges corresponding to apertures 66 and 65 in FIG. 7 and through the registering apertures in the shelves of tray 42, provide a pivotal mounting for the auxiliary reflector panel 40.

In FIG. 1, the axes of pivotal movement of the auxiliary side reflector panels 40 and 41 are indicated by the dot and dash lines 132 and 133, respectively. Correspondingly, the axes of pivotal movement of the lighting and reflector units 37 and 38 with respect to the intermediate panel 39 are indicated by the dot and dash lines 134 and 135, respectively.

Figure 5:
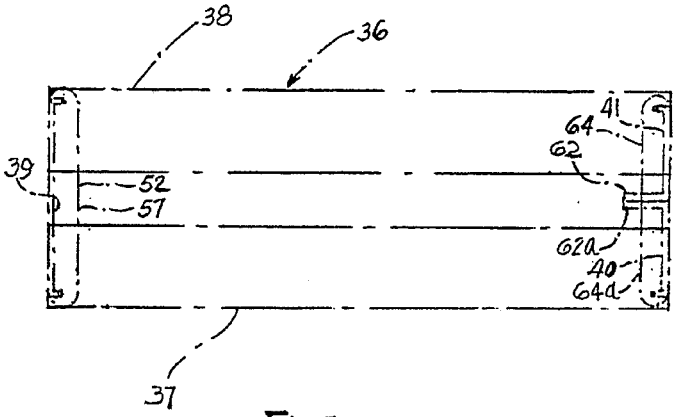
FIG. 5 is a plan view in dot and dash lines showing the unitary articulated lighting and reflector assembly in folded position and ready for placement in a shipper.

To fold the articulated lighting and reflector assembly 36 to its alternative configuration shown in FIG. 5 for packing, the auxiliary reflective panels 40 and 41 are first swung forwardly, i.e. upwardly, to a position normal to the main back wall portions 44 and 45 of the trays 42 and 43, respectively. In this position the lower and upper flanges 64 and 63 of the auxiliary reflective panel 41 engage the adjacent ends of the upturned flange 49 on the lower shelf 47 and the corresponding downturned flange 51 of upper shelf 50. Similarly the lower flange 64a of said auxiliary reflective panel 40 and the corresponding upper flange thereof (not shown) are in engagement with the adjacent ends of the upturned flange 48 of lower shelf 46 and the corresponding downturned flange (not shown) on the upper shelf of tray 42, respectively.

The outer ends of the lighting and reflector units 37 and 38 are then swung forwardly, i.e. upwardly, into the positions normal to the intermediate reflector panel 39 and in general parallelism with each other shown in dot and dash lines in FIG. 5. In this folded position the flanges 62 and 62*a* of the auxiliary reflector panels 41 and 40 are in the laminar abutment shown. With the lighting and reflector assembly 36 in the folded alternative or shipping configuration shown in FIG. 5, it is ready for placement in a shipper. The presently preferred dimensions of the folded assembly 36 are about 36¼ inches high, about 24 inches wide, and about 8 inches thick.

Figure 10:
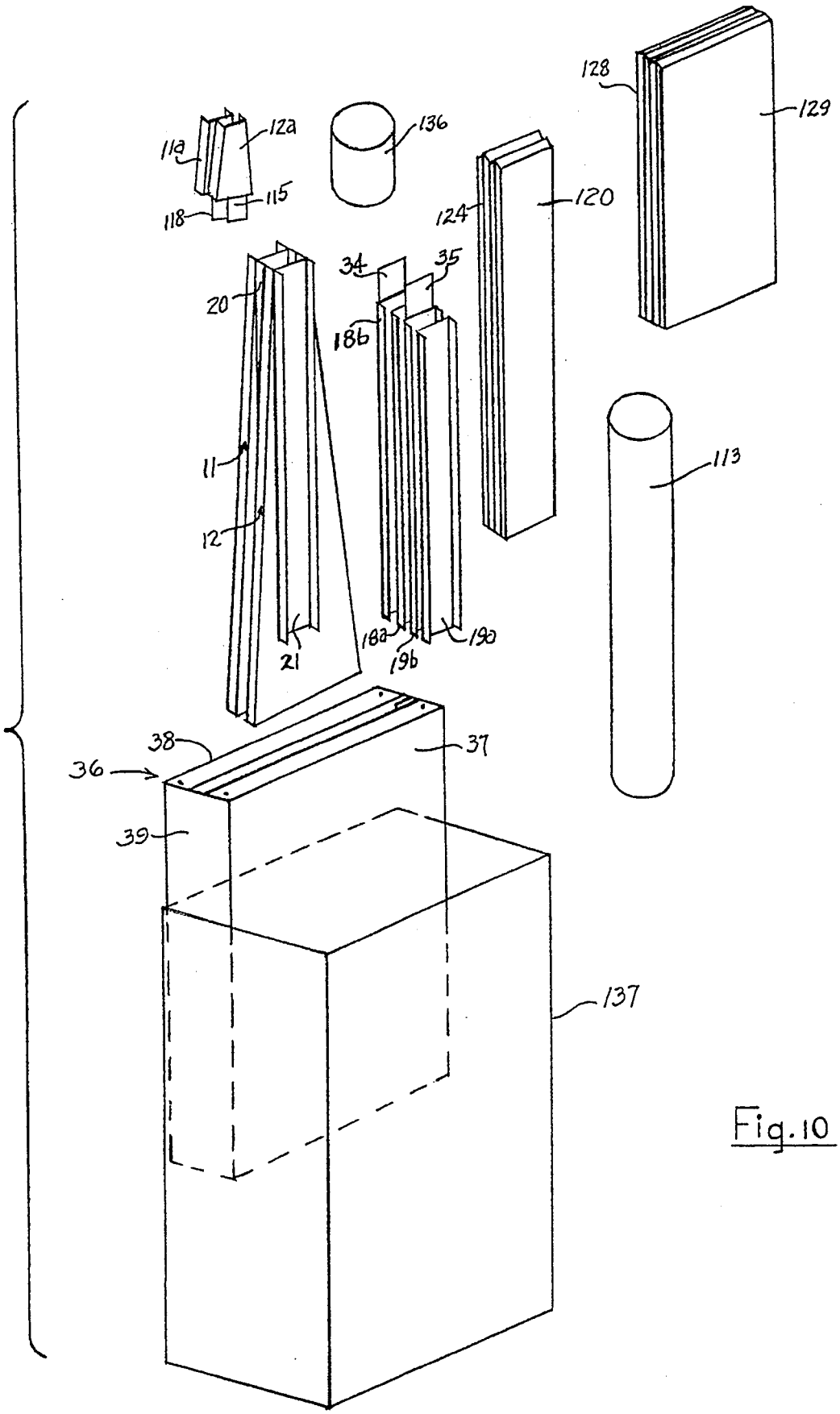
FIG. 10 is an exploded view showing the disassembled components of the invention arranged for placement into a shipper.

FIG. 10 illustrates the folded assembly 36 and the various other parts of the illustrated embodiments of the invention as disassembled and ready for placement in a shipper 137. The presently preferred dimensions for such a shipper are, vertical height about 43 inches, width about 25 inches and thickness about 18 inches. In the preferred sequence of packing the parts shown in FIG. 10 into shipper 137, the folded lighting and reflector assembly 36 is placed in the shipper first, against one side wall thereof. Next, the matched pair of broad based supporting members 11 and 12 are placed in the shipper in face to face relation with and next to the folded assembly 36 and adjacent one end wall of the shipper.

The folded flat panels 128 and 129 of FIG. 9, if present, are then placed in the shipper in face to face relation with and next to the supporting members 11 and 12, and also adjacent said end wall of the shipper. The folded header and subheader panels 120 and 124 are then placed in the shipper in face to face relation with the folded panels 128 and 129, and also adjacent said shipper end wall. The frame member sections 18*a*, 18*b*, 19*a*, and 19*b*, aligned one behind the other, are then placed in side by side relation with the panels 120 and 124. The rolled display panel 113, with the rolled flexible panels 126 and 127, if used, rolled therewith, is then placed in the shipper between the folded assembly 36 and the opposite shipper side wall and adjacent the end wall thereof opposite said one end wall. Suitably sized foam plastic blocks are used in the shipper 137 to fill vacant spaces available at the sides of the various elements placed therein.

There is ample space in the shipper 137 above the folded lighting and reflector assembly 36 to accommodate the top sections 11*a* and 12*a* of the supporting members 11 and 12, respectively. Also readily accommodated in the shipper 137 along with said top sections is a container 136 for eight or more of the quarter turn connectors of the type used to hold the structure of the invention in the assembled relationship illustrated in the drawings.

The shipper 137 may be made of any suitable tough material such as, for example, plastic. It may be provided with a box like cover (not shown) which fits telescopically thereover and is fixed thereon, as by straps or suitable latch means (not shown). If desired, the shipper may be provided with suitable wheels (not shown) adjacent corresponding bottom corners thereof, and the cover therefor may be provided with a suitable handle (not shown) to facilitate pulling of the wheeled shipper as suitable or desired. The loaded shipper 137 can be checked with other luggage for travel from one tradeshow to another.

When the loaded shipper 137 arrives at the destination of the next tradeshow, the components of the invention, can be quickly and easily assembled as follows. With the shipper opened, the rolled display panel 113 is removed therefrom and set aside for later attention. The frame member sections 18*a*, 18*b* and 19*b* are then removed and reassembled, by reversing the procedure for disassembly thereof, to provide the frame members 18 and 19, which are then also set aside. The wide based supporting members 11 and 12 are then removed and set aside. The folded header and subheader panels 120 and 124, respectively, are then laid end to end longitudinally on a table of the type mentioned earlier herein and generally centered thereon.

The lighting and reflector unit assembly 36, in its alternative folded configuration, is then removed from the shipper and placed on the folded panels 120 and 124 with intermediate panel 39 flat thereon and the longitudinal axis of said panel generally normal to the longitudinal axes of folded panels 120 and 124. The lighting and reflector units 37 and 38 are then unfolded outwardly, i.e., longitudinally of the table, to bring the main or back walls of said units flat on the panels 120 and 124. The auxiliary reflector panels 40 and 41 are then unfolded outwardly to also lie flat on panels 120 and 124 to complete the return of assembly 36 to its operative configuration.

Placement of the assembly 36 on panels 120 and 124 spaces said assembly above the table surface and facilitates the application of the assembled frame members 18 and 19 thereto. Frame members 18 and 19 are then respectively applied to the upper and lower ends of the lighting and reflector units 37 and 38, with the rear longitudinal flanges 26 and 27 of said frame members overlapping the back wall portions of the trays of said units. In this position, the upper frame member 18 is attached to the upper shelves of the trays 37 and 38 by reinserting the connector 84 through the aperture 87 in the web of channel 18*b*, and through the registering aperture 88 in the upper shelf of tray 43, and then rotating said connector one quarter turn when the transverse pin 86 thereof has cleared the lower surface of shelf 50, after which the connector is released.

Another of said connectors (not shown) is reinserted through the other keyhole type aperture (not shown) in the web of frame member section 18*a* and through the registering keyhole type aperture (not shown) in the top shelf of tray 42, both of which are in coaxial alignment with the aperture 74 in lower shelf 46 of tray 42. When the transverse pin of the last mentioned connector clears the lower surface of the upper shelf of tray 42, said connector is rotated one quarter turn and released.

The lower frame member 19 is connected to the lower ends of the lighting and reflector units 37 and 38 by reinserting the connectors 77 and 90 through the keyhole type apertures in sections 19*b* and 19*a* which are in registration with the apertures 75 and 74 in lower shelves of trays 43 and 42, respectively, then turning said connectors one quarter turn and releasing them.

The right hand supporting member 12, with the side frame channel 21 carried thereby, is then attached to the flange 62 of lighting and reflector unit 38 by reinserting the connectors 71 and 73 through the lower and upper keyhole type apertures in the web of the supporting member 12, in the web of side frame member 21 and in the flange 62, respectively. The connectors 71 and 73 are rotated one quarter turn after the transverse pins thereof clear the inner surface of flange 62, and are then released.

The left hand supporting member 11, together with side frame member 21, is then attached to the flange 62*a* of panel 40 by the use of connector 72 and the connector (not shown) in vertical alignment therewith, following the same procedure described with respect to the attachment of supporting member 12.

The articulated lighting and reflector assembly 36 is now secured in operative position within the frame 17, and the supporting members 11 and 12 are securely attached thereto. The structure thus assembled is then removed from the-table and stood upright with the bases of supporting members 11 and 12 on the floor. The top sections 11*a* and 12*a* are replaced on the upper ends of supporting members 11 and 12 by reinserting the bars or tongues 118 and 115 within the straps 119 and 117, respectively, with a downward sliding movement.

The header panel 120 is then unfolded and, if the end panels 126 and 127 are not to be used, the hook strip type connectors on the end portions of panel 120 are applied to the velvet loop type connector strips bonded to the front flanges of supporting sections 11a and 12*a* in the operative position shown in FIGS. 1 and 2. The subheader panel is then unfolded, and mounted in the operative position shown in FIGS. 1 and 2 by application of the hook strip type connectors on the end portions thereof to the velvet loop type connector strips bonded to the front surfaces of flanges 123 and 122 on supporting members 11 and 12.

If the semiconical panels 126 and 127 are to be used, they are unrolled and, prior to the mounting of header panel 120, the side marginal portions of panels 126 and 127 having hook type connector strips bound to the back thereof are pressed onto the velvet loop type connector strips bonded to the front and back flanges of the support members 11 and 12, respectively, in the positions shown in FIG. 8. The hook strip type connectors on the end portions of header panel 120 are then applied to the velvet loop type connector strips on the front of the upper front marginal portions of panels 126 and 127 overlaying the front flanges of sections 11*a* and 12*a* of members 11 and 12.

If the flat panels 128 and 129 are to be used, the supporting brackets 138 and 129 on front flange 13 of supporting member 11 and supporting brackets 140 and 141 on the front flange 15 of supporting member 12 are swung downwardly and outwardly from the stored or shipping positions thereof to their horizontal operative positions shown in FIG. 9. Panels 128 and 129 are then unfolded, and the side marginal portions having the hook type connector strips bound to the back thereof are applied to the front surface of the flanges 13 and 15 of supporting members 11 and 12 respectively in the positions shown in FIG. 9.

The flexible display panel 113 is then unrolled, and the upper marginal portions thereof having hook type connector strips bound to the back thereof are smoothly pressed against the velvet loop connector strips bound to the front surface of the front flange 22 of upper frame sections 18*a* and 18*b*. With the panel 113 stretched across the front of frame 17, the side marginal portions of said panel having hook type connector strips bound to the back thereof is smoothly pressed against the velvet loop type connector strips on the front surface of the flanges 24 and 25 of side frame members 20 and 21. Bottom marginal portions of panel 113 having a hook type connector strip bound to the back thereof is then pressed smoothly against the velvet loop type fabric strips bound to the front surface of the front flange 23 of bottom frame sections 19*a* and 19*b*.

Following application of auxiliary graphics to the header and subheader panels and to whichever of the panels 126 and 127 or panels 128 and 129 are used, the display of the invention is ready for use. It is then placed on the table therefor, and is plugged into a source of electrical current for illumination of the display panel 113.

Various changes and modifications in the invention disclosed herein will become apparent to those skilled in the art, and all of such changes and modifications are contemplated as may come within the scope of the appended claims.

What is claimed is:

1. An articulated lighting assembly for a backlit display, comprising in combination at least two generally rectangular trays each having a light reflective generally planar main wall portion having an inner edge portion and having at least one elongated rectilinear tubular lamp mounted thereon in spaced generally parallel relation with said main wall portion; a generally rectangular intermediate reflective panel having opposite edge portions adjacent said tray inner edge portions respectively; means connecting said intermediate panel and said trays for relative movement between an operative assembly configuration wherein the main wall portions of said trays and said intermediate panel are in generally coplanar relation and an alternative assembly configuration wherein said main wall portions of said trays are in opposing generally parallel relation; a pair of rectangular auxiliary reflective panels; and means connecting said auxiliary panels and said trays for relative movement by which said auxiliary panels are movable from positions in generally coplanar relation with the main wall portions of said two trays when said lighting assembly is in said operative configuration to positions normal to the main wall portions of said trays when said lighting assembly is in said alternative configuration, said auxiliary panels having flanges which extend normal thereto along edges thereof remote from their connection with said trays.

2. The lighting assembly of claim 1 in combination with at least one supporting member to which said lighting assembly is readily removably secured in said operative configuration thereof.

3. The lighting assembly of claim 1 wherein the means connecting said intermediate panel and said trays are pivotal connections allowing said two trays to fold between said coplanar relationship and said opposing parallel relationship.

4. The lighting assembly of claim 1 wherein the means connecting said auxiliary panels with the main wall portions of said two trays are pivotal connections.

5. The lighting assembly of claim 1 in combination with a generally rectangular frame having a pair of spaced horizontal top and bottom members to which said two trays are readily removably connected in said operative configuration, and a pair of spaced vertical side members to which said auxiliary panel members are readily removably connected in said operative configuration.

6. The combination of claim 5 wherein said auxiliary panel members are connected to said frame side members by means for readily removably connecting said flanges to said side members.

7. The combination of claim 5 wherein said top and bottom frame members are formed of sections provided with separable connection means permitting ready disposition of said sections in assembled operative relation and disassembled alternative relation.

8. The combination of claim 5 wherein said frame members have generally coplanar front surfaces, which combination additionally comprises a substantially one-piece generally planar light transmissive image bearing display panel mounted on and extending across the front of said frame.

9. The combination of claim 8 wherein said display panel is flexible and has generally the same size and shape as the front of said rectangular frame, and marginal portions of said display panel are readily removably fastened to the coplanar front surfaces of said frame members.

10. A backlit display comprising in combination a rectangular frame having opposing horizontal and vertical members defining a rectangular opening, said frame members having generally coplanar front surfaces; an articulated lighting assembly comprising at least two trays, each having a main wall portion with a diffusely reflective surface; a plurality of elongated cylindrical fluorescent lamps carried by said trays adjacent said reflective surfaces in spaced parallel relation with each other and with said tray main wall portions; means connecting said trays for pivotal movement of each tray about an axis generally parallel with the axes of said lamps and affording said lighting assembly an operative configuration in which said trays are in generally coplanar relation; means for readily removably connecting said lighting assembly in said operative configuration and as a unit to said rectangular frame with said diffusely reflective surfaces and lamps, spaced from, and generally parallel with said frame front surface; and an image bearing light transmissive display panel extending across said frame rectangular opening and having marginal portions removably attached to said frame members.

11. The backlit display of claim 10 wherein said frame members are inwardly facing horizontal and vertical channel members having spaced flanges within which said trays are disposed.

12. The backlit display of claim 10 wherein, upon separation of said lighting assembly and said frame, said at least two trays are foldable to afford said lighting assembly an alternative configuration wherein the main wall portions of said trays are in opposing generally parallel relation.

13. The backlit display of claim 10 wherein said means for connecting said lighting assembly and said frame also provides connection means for readily releasably holding said frame members in assembled relation.

14. The backlit display of claim 10 which further comprises a pair of frame supporting members fixed respectively to said opposing vertical frame members.

15. An articulated lighting assembly for a backlit display comprising in combination a pair of spaced generally parallel trays each having a rectangular main wall portion with a diffusely light reflective surface, a plurality of elongated rectilinear tubular lamps carried by each of said trays in uniformly spaced parallel relation adjacent and parallel with the reflective surface of the respective trays, said lighting unit having an operative configuration in which the main wall portions of the trays thereof are generally coplanar and adjacent edge portions thereof are in spaced generally parallel relation; a generally planar rectangular intermediate panel disposed between the main wall portions of said trays and substantially coplanar therewith when said lighting assembly is in said operative configuration, said intermediate panel also having a diffusely light reflective surface; means connecting said intermediate panel and said trays for relative movement of said trays with respect to said intermediate panel from said coplanar relationship therewith to an alternative relationship defining an alternative configuration of said lighting assembly; the lamps on the respective trays which are closest to said intermediate panel being spaced apart, when said lighting assembly is in its operative configuration, an interaxial distance generally equal to the uniform spacing between all the other adjacent lamps in said assembly; and an auxiliary rectangular panel connected to each of said trays for relative movement from positions in coplanar relation with respect to said trays when said lighting assembly is in said operative configuration to alternative positions in which they are disposed when said lighting assembly is in its alternative configuration, said auxiliary panels each having a diffusely light reflective surface and a width effective in the operative configuration in said assembly to space the edges thereof remote from said trays a distance from the axis of the respective lamps to which they are nearest equal to about one-half the uniform interaxial distance between adjacent lamps, said auxiliary panels being provided along the edges thereof remote from said trays with flanges which extend normal thereto.

16. The lighting assembly of claim 15 wherein the main wall portions of said trays are in opposing spaced generally parallel relation when said lighting assembly is in said alternative configuration.

17. The lighting assembly of claim 15 wherein the means connecting said trays and said intermediate panel are pivotal connection means which allow pivotal movement of said trays between said coplanar and alternative relationships.

18. The lighting assembly of claim 15 wherein the alternative positions of said auxiliary panels are substantially normal to said trays.

19. The lighting assembly of claim 18 wherein the connections of said auxiliary panels to said trays are pivotal connections which allow pivotal movement of said auxiliary panels between said positions coplanar and normal to said trays.

20. A backlit display comprising in combination a rectangular frame having frame members provided with narrow generally coplanar front surfaces and which define a rectangular opening; an articulated lighting assembly having a plurality of pivotally connected trays, said assembly being readily removably connected as a unit to said frame and comprising a plurality of rectilinear tubular lamps mounted on said trays in substantially equally spaced parallel relation;

a pair of supporting members connected to said frame; and a rectangular substantially one piece light transmissive image bearing display panel extending across said opening and having marginal portions readily removably connected in laminate relation to the coplanar front surfaces of said frame members.

21. The combination of claim 20 wherein said supporting members extend above said frame, and which further comprises a generally planar header panel projecting upwardly from said frame; and means on said supporting members for supporting said header panel.

22. The combination of claim 21 wherein said vertical supporting members each have a removable top section above said frame, which sections each carry supporting means for said header panel.

23. The combination of claim 20 wherein said supporting members extend below said frame and which further comprises a generally planar subheader panel projecting downwardly from said frame; and means on said supporting members for supporting said subheader panel.

24. The combination of claim 20 which further comprises at least one panel member which projects laterally outwardly from and is supported by one of said supporting members.

25. The combination of claim 24 wherein said supporting members are tapered and in which said at least one panel is generally semiconical.

26. The combination of claim 24 in which said at least one panel is generally flat.

27. A backlit display comprising in combination a rectangular frame having frame members provided with generally coplanar front surfaces and which define a rectangular opening; an articulated lighting assembly having a plurality of pivotally connected trays, said assembly being readily removably connected as a unit within said frame and comprising a plurality of rectilinear tubular lamps mounted on said trays in substantially equally spaced parallel relation; and a rectangular substantially one piece light transmissive image bearing display panel extending across said opening and having marginal portions readily removably connected in laminate relation to the coplanar front surfaces of said frame members.

* * * * *